United States Patent [19]

Entringer

[11] 3,945,201

[45] Mar. 23, 1976

[54] MARINE JET DRIVE SHIFT CONTROL APPARATUS

[75] Inventor: David C. Entringer, Fond du Lac, Wis.

[73] Assignee: Brunswick Corporation, Skokie, Ill.

[22] Filed: Jan. 27, 1975

[21] Appl. No.: 544,375

[52] U.S. Cl. ..... 60/222; 60/230; 114/144 R; 115/12 R; 239/265.27; 74/480 B; 74/531; 114/144 B

[51] Int. Cl.[2] ..... B63H 25/46

[58] Field of Search ..... 60/221, 222, 228, 229, 60/230; 114/144 R, 151, 144 B; 115/12 R; 239/265.19, 265.27; 74/480 B, 531, 527

[56] References Cited

UNITED STATES PATENTS

| | | | |
|---|---|---|---|
| 2,402,724 | 6/1946 | Bidwell | 74/480 B |
| 2,691,953 | 10/1954 | Hanley | 115/12 R |
| 2,846,896 | 8/1958 | Allen | 74/480 B |
| 2,957,352 | 10/1960 | Pierce | 74/480 B |
| 2,960,199 | 11/1960 | Morse | 74/480 B |
| 3,055,175 | 9/1962 | Clark | 60/221 |
| 3,295,490 | 1/1967 | Hiatt | 60/221 X |
| 3,795,105 | 3/1974 | Aschauer | 60/221 |

*Primary Examiner*—Clarence R. Gordon
*Attorney, Agent, or Firm*—Andrus, Sceales, Starke & Sawall

[57] ABSTRACT

A marine jet drive unit includes a continuously running pump. A reversing gate is positioned partially or wholly within the forward jet to establish a corresponding reverse jet. For neutral drive, the gate is positioned such that the reverse jet just balances the forward jet. A remote shift control unit includes a detent means for locating and holding a rotatable shift lever in neutral. The detent means includes a pair of detent pins carried by a plate which is connected to a support wall by a slot and bolt lost motion connection. The pins are located to opposite sides of the lever and the connection permits angular adjustment about the pivot axis of the lever. The plate supports the detent pin in alignment with a circular outer periphery of the lever plate having oppositely located radial detent grooves. The lever is connected by a push-pull cable to the gate. The precise neutral position of the lever may vary for different drive units. The lever and gate are positioned to establish neutral setting for the particular engine-pump unit. The detent plate is then adjusted to align the detent pins with the grooves and the bolts drawn up to lock the detent plate in a fixed neutral position.

18 Claims, 4 Drawing Figures

MARINE JET DRIVE SHIFT CONTROL APPARATUS

BACKGROUND OF THE INVENTION

The present invention relates to marine jet drive shift control apparatus for accurately shifting of the jet drive into a neutral position.

Marine jet propulsion drive systems have recently been commercially developed for propelling relatively small recreational type vehicles and the like. Generally, the jet propulsion drive system is mounted to the aft or stern portion within the boat with an internal combustion engine driving a suitable pump unit for drawing water upwardly through a bottom intake opening and discharging of the water rearwardly through a transom-mounted jet nozzle unit. For forward movement, the jet is discharged, through a nozzle, longitudinally rearwardly of the boat. For reversing the direction of boat travel, a diverting means is employed for reversing the direction of the jet stream toward the front of the boat and thereby reversing the thrust created by such jet stream. Generally, a lid or gate is pivotally mounted to the forward thrust jet forming nozzle and is adapted to be moved downwardly into the jet path so as to deflect and redirect the jet downwardly into a reverse thrust jet forming nozzle. The gate may be a simple plate-like member pivotally mounted to the sidewalls of the forward jet nozzle and adapted to be pivoted downwardly into partial or complete overlying relationship to the discharge end of the forward jet nozzle. An internal gating system may also be employed for redirecting of the output of the pump flow from the forward forming jet nozzle to a reverse jet nozzle, such as shown in the pending application of William L. Woodfill, entitled, "MARINE JET DRIVE PROPULSION APPARATUS" which was filed with SER. No. 317,200, on DEC. 21, 1972, and which is assigned to the same assignee as the present application. In each construction, a remote control lever or other means is coupled to the gate for selective positioning thereof. Generally, a pivotally mounted lever is coupled to the gate by a suitable push-pull cable unit in the same general manner as remote controls for conventional propeller driven systems.

Generally, all marine jet drives include a continuously running pump which operates as long as the drive engine is operating. The thrust output is thus maintained and differs from the more conventional marine prop drive where the propeller is operatively disconnected from the engine to stop the propulsion or thrust forces. In order to hold a neutral setting for holding a jet driven boat stationary, the reversing gate means is positioned partially within the forward jet stream to establish a partial reverse jet which will just balance the forward jet thrust forces. This not only requires a reasonable sensitive setting of the control but the setting will tend to vary with the idle speed of the engine. When the shift control apparatus is formed for various jet drives on a production basis, the connection means will often not provide precise positioning of the gate means, to create equal and opposite forward and reverse thrust forces. Tailoring or customizing of the shift control connection to the engine is, therefore, generally required. Further, engine operation may tend to vary with time and require readjustment of the gate setting which will normally demand restructuring of the linkage.

SUMMARY OF THE PRESENT INVENTION

The present invention is particularly directed to a jet drive shift control apparatus with a convenient initial adjustment means for reliable and accurate setting of the jet control in a neutral position. Generally, in accordance with the present invention, a remote shift control unit or apparatus includes a releasable holding means for holding of a movable shift setting means in a predetermined neutral position. The shift setting means is movable therefrom to provide forward and reverse drive setting of the jet diverting means. In accordance with the present invention, the releasable holding means includes interacting elements which are adjustably coupled to the shift means and a support to adjust the holding position with respect to the movable shift setting means. In practice, the remote shift control apparatus is coupled to the jet drive with a rough setting between the movable shift setting means the jet diverting means. The reversing or diverting means accurately positioned by moving of the shift setting means to establish the precise neutral point for that particular combination of engine and jet drive unit. The releasable means is then reoriented to engagement and set to establish a fixed holding neutral position. Thereafter, placing of the movable control in the neutral position will repeatedly produce the desired neutral positioning of the jet diverting means.

In accordance with a particularly novel feature and construction of the present invention, the remote control unit includes a support wall with a pivotally mounted shift lever thereon. The lever is connected to the remote end of a suitable coupling cable unit which extends from the remote control unit and is coupled to the jet diverting means. The holding means is of a mechanical type and includes a holding element which is secured to the lever support wall to resiliently engage a holding element on the lever. At least one of the holding elements is adjustably mounted for positioning in the path of the holding element traversed as the lever moves. In a practical construction a detent means was employed with a detent pin carried by a plate connected to the support wall by a suitable lost motion connection permitting angular adjustment of the plate relative to the orientation of the lever. The plate supported the detent pin in alignment with a circular outer periphery of the lever plate. In the operation, the neutral position is determined by engagement of the holding or detent means which can be readily detected by movement of the lever into and from the holding position. For fine adjustment, the lever and the diverting means are positioned to provide opposite thrust forces. The detent means is then adjusted to align the detent pin carried by the plate with the detent means of the lever plate. The detent plate is then fixed in position with the pressure engaging detent pin accurately positioned in accordance with the neutral position.

The jet shift control means of this invention has been found to provide a simple and reliable means of permitting the precise accurate adjustment of the shift mechanism for various jet drive systems and, in particular, readily permits adjustment to compensate for the necessary manufacturing tolerances required for producing of jet drive systems and the like, as well as any subsequent readjustment as the result of wear or changing operating conditions.

BRIEF DESCRIPTION OF DRAWINGS

The drawings furnished herewith illustrate the best mode presently contemplated by the inventor for carrying out the subject invention in which the above advantages and features are clearly disclosed as well as others which will be readily understood from the following description of the embodiments shown.

In the drawings.

DESCRIPTION OF ILLUSTRATED EMBODIMENT

Figure 1:
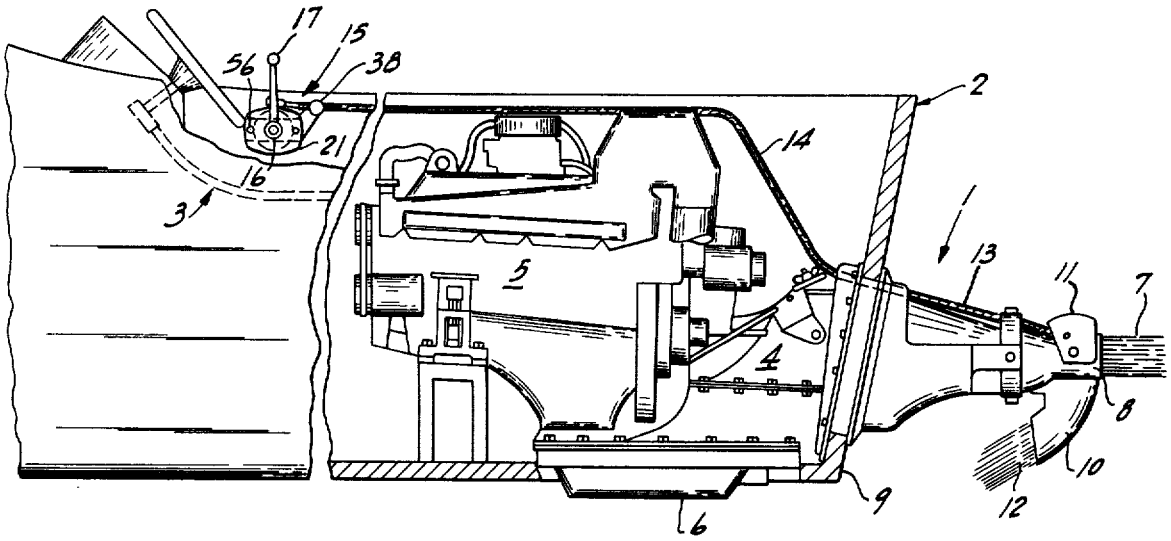
FIG. 1 is a fragmentary side elevational view of a recreational boat with a jet drive means and a remote control constructed in accordance with the teaching of the present invention.

Referring to the drawings and particularly to FIG. 1, the present invention is shown in connection with a jet propulsion drive unit 1 secured to the aft portion of a boat 2 such as a small recreational boat. The boat operating controls are normally provided adjacent the front of the boat at a steering station 3. Generally, the drive unit 1 includes a water pump unit 4 mounted immediately within the aft end of the boat and driven from an adjacent internal combustion engine 5. The pump unit 4 is of any suitable construction adapted to draw water upwardly from a bottom opening 6, pressurize and discharge the water as a high force jet 7 through a jet nozzle 8 which is secured to the stern or transom 9 of the boat 2. A reverse thrust nozzle 10 is secured to the underside of the forward jet nozzle unit 8. A reversing gate 11 is pivotally secured to the jet nozzle 8. The gate 11 is adapted to move downwardly into the path of the forward jet 7, for diversions thereof into the reverse nozzle 10, to thereby generate a reverse jet 12. Complete diversion of the output of the pump 4 into the reverse nozzle 10 establishes a maximum reverse movement of the boat 2. Intermediate positioning of the gate 11 establishes both the forward and reverse jets 7 and 12 with a corresponding relative movement of the boat 2. The positioning of the gate 11 is generally controlled by a shift rod 13 which extends through the boat transom 9 and is coupled or connected by a push-pull cable unit 14 or the like to a remote shift control unit 15 at the front control or steering control station 3. In the illustrated embodiment of the invention, the push-pull cable assembly or unit 14 is connected by a coupling means 16 within the control unit 15 to a shift lever 17 projecting upwardly therefrom. Lever 17 is rotatably mounted, as hereinafter described, to permit the positioning of the gate 11 in any desired overlying relationship to the output of the jet nozzle 8 for selective diversion of the output of the pump 4 into reverse nozzle 10.

In the illustrated embodiment of the invention, the remote shift control unit 15 is shown as a single lever unit solely controlling the shifting of the drive between neutral, forward and reverse. In actual practice, a separate throttle control for the engine may be provided, or a single lever throttle and shift control means can, of course, be provided with suitable lost motion coupling means between the elements providing for shifting of the drive prior to acceleration, if desired. Such a construction is well-known in the conventional outboard motor and stern drive systems and, consequently, no further description or illustration thereof is given.

The particular gate structure and construction of the drive unit 1 may also be widely varied in accordance with any known or desired construction. Similarly, the connection or coupling unit 14 for connecting of the remote control unit 15 to the gate 11 may similarly be any well known or desired construction. Consequently, no further description or details of such elements are given other than as necessarily to explain the present invention.

The present invention is particularly directed to the provision of a unique coupling means 16 to permit the initial setting of the control lever 17 and the gate element 11 to accurately establish and maintain the neutral position by merely moving the lever 17 to a predetermined, repeatable position. The construction of a preferred embodiment of the control unit 15 is shown and described to clearly illustrate one construction of the present invention.

Figure 2:
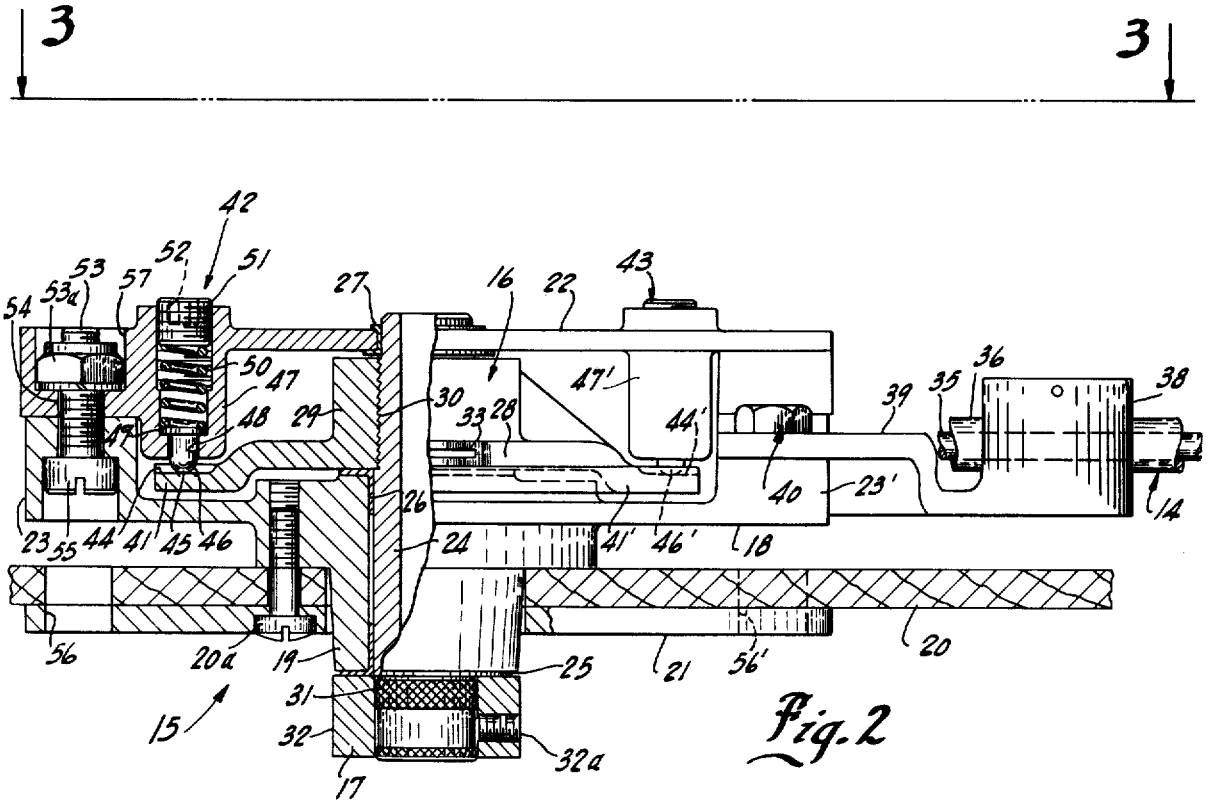
FIG. 2 is an enlarged top elevational view with parts broken away and sectioned to illustrate inner details of construction.
Figure 3:
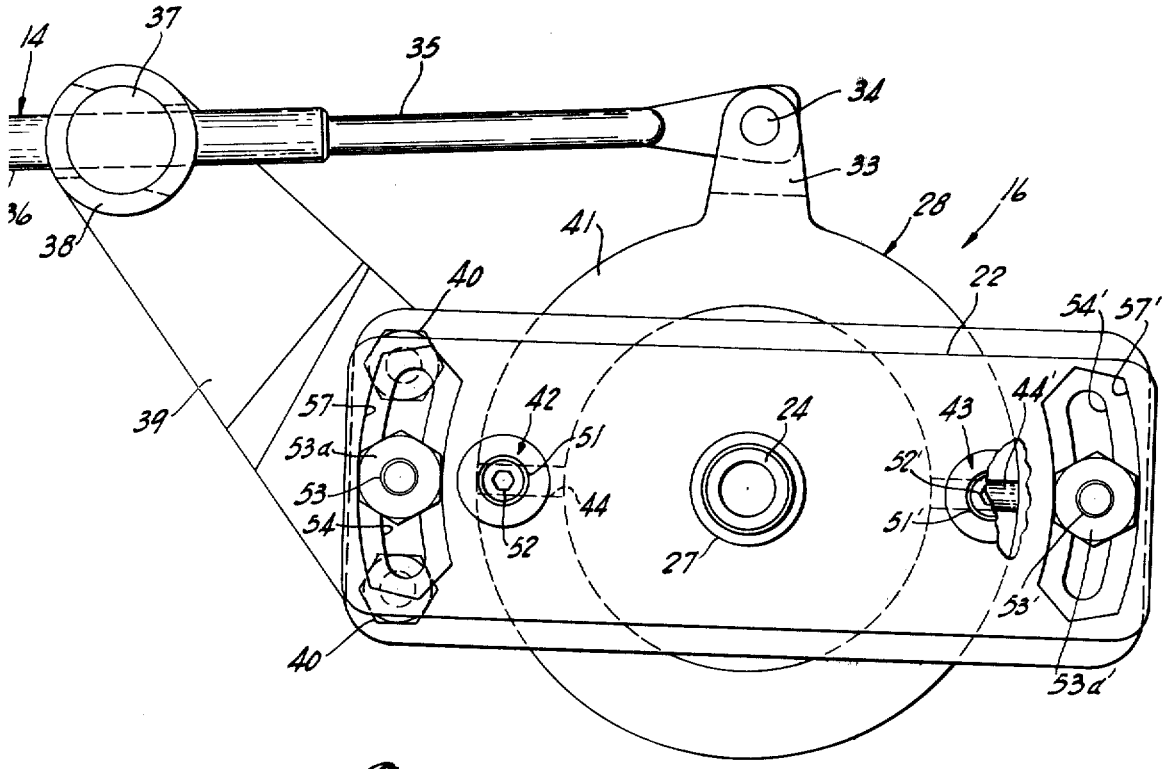
FIG. 3 is a rear elevational view of the remote control unit and taken generally on line 3—3 of FIG. 2, with parts broken away and sectioned.

Referring more particularly to FIGS. 2 and 3, the illustrated remote shift control unit 15 includes a supporting housing structure including a generally, U-shaped front support wall 18, having a bearing hub 19 which projects forwardly therefrom. The remote control unit 15 is adapted to be mounted behind an internal wall 20 within the boat 2 with the hub 19 projecting through an opening in such wall and the adjacent hub wall portion abutting the inner surface of the wall 20. The unit 15 is rigidly afixing to the wall by suitable attachment screws 20*a*, shown passing through the wall 20 and into suitably tapped openings in the adjacent support wall 18. A suitable bezel 21 is slipped over the hub portion 19 to the outer or exterior side of the wall 20 to maintain a pleasing appearance.

The U-shaped front wall 18 opens rearwardly behind the wall 20 with a removable back wall or plate 22 releasable secured thereto. In the illustrated embodiment, the U-shaped front wall 18 includes a pair of longitudinally spaced side elements or walls 23 to which plate 22 is secured as presently described.

A lever shaft 24 is journaled in the hub 19 and the back wall 22, with suitable radial and thrust bearings 25 and 26 secured to the opposite ends of the hub 19 and a suitable radial bearing 27 secured within an appropriate opening in back wall 22. The bearings 25 and 26, as most clearly shown in FIG. 2, include a radial or cylindrical portion located within the corresponding end of the hub 19 and an outwardly projected flange portion defining a thrust bearing support. The bearing 27 in turn is a conventional split bearing having a generally U-shaped configuration telescoped over the edge of the opening in the back wall 22.

A shift lever plate 28 is provided with a mounting hub 29 secured to the shaft 24 and located between the front and back walls 18 and 22 between the sidewalls 23. The shaft 24 and mounting hub 29 are knurled as at 30, and the mounting of 29 is press fitted onto the shaft 24 to provide a firm physical interengagement therebetween. In the assembled relations, the base of the shift lever plate 28 adjacent to front wall 18 abuts the flange portion of the corresponding bearing 26.

The shaft 24 is provided with a knurled outer end portion 31 to receive the lever arm 17 which is correspondingly provided with hub 32 which telescopes over the shaft which may be secured thereto in any suitable manner such as a set screw 32*a* which passes through the lever hub 32 into an abutting engagement with an annular recess on the shaft 24. The lever hub 32 abuts the front flange of the outer hub bearing 25 and thereby serves to clamp the shift lever plate 28 in position within the support, as shown most clearly in the FIG. 2.

Figure 4:
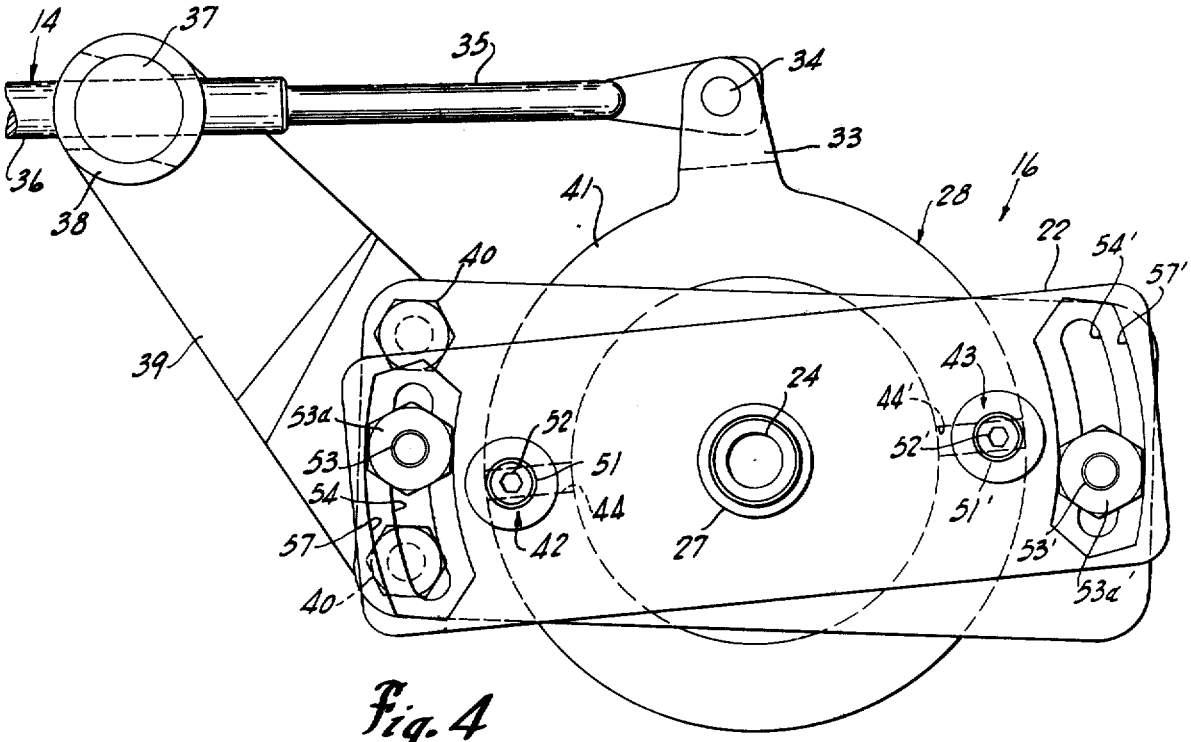
FIG. 4 is view similar to FIG. 3 showing an alternate setting of the control.

A shift lever arm 33 housing an outer bifurcated end is integrally formed with the mounting hub 29 and projects radially upward through the open end between the sidewalls 23 for coupling to unit 14, as shown in FIGS. 3 and 4.

A conventional pivot connection 34 connects the outer end of a cable 35 of the push-pull cable unit 14 to the outer end of the lever arm 33. The cable 35 extends rearwardly from the arm through a cable sheave 36 which is secured against longitudinal movement to the support wall 18. Thus the cable sheath 36 is shown provided with a conventional clamping pin 37 located within a clamping hub member 38. The member 38 has an opening permitting limited pivotal movement of the sheath 36 but preventing longitudinal movement thereof. The clamp hub member 38 is formed as an integral part of a bracket 39 secured to the adjacent back side of the wall 18 as by bolts 40.

The shift lever plate 28 is shown as a generally circular plate having the centrally located hub 29 and the lever arm 33 extending radially upwardly therefrom. The outer periphery of the plate is formed as a slightly offset bearing rim 41 which extends downwardly over the inner bearing hub portion of the front wall 18. Resilient detent means 42 and 43 are located to the opposite sides of the control shift lever arm 33 and releasably couple the plate 28 to the back wall 22 to hold the plate 28 with lever arm 33 in a neutral position.

Each of the detent means 42 and 43 is similarly constructed and consequently the unit 42 will be described in detail with corresponding prime numbers identifying corresponding elements of the opposite element or unit 43. The detent means 42 includes a generally radial groove or recess 44 formed in the rim 41 of plate 28. The radially extended recess 44 generally has a generally circular cross-section configuration and is adapted to receive the semi-cylindrical end 45 of a detent pin 46 which is formed of a similar radius to that of the recess and is carried by the rear or back wall 22 in alignment with rim 41. pin 46 may also be formed as an elongated plate-like projection with a rounded edge mating with the recess 44. Pin 46 is shown resiliently mounted to define one form of a releasable holding means as follows: The back wall 22 is formed with an inwardly projecting cylinder 47 which terminates in slightly spaced relation to the offset rim 41. The inner end of the cylinder 47 is provided with a reduced opening 48 corresponding to the diameter of the detent pin 46, which projects through said opening into the detent recess 44. The pin 46 includes an inner flange 49 abutting the adjacent wall of the reduced opening. The pin 46 is resiliently forced outwardly by a coil spring 50 located and secured within the hub 47 by a small pressure screw 51 threaded or otherwise adjustably secured within the outer end of the cylinder 47. The screw 51 is accessible from the aft side of the control and as shown is provided with a suitable allen wrench opening 52 for presetting of the compression of the coil spring 50, and the detent holding pressure.

The wall or plate 22, as most clearly shown in FIGS. 2 and 3, is secured to the opposite side walls 23 by a pair of clamping bolts 53 which pass through the sidewalls 23 plate 22 and receive clamping nuts 53*a*. The plate 22 is provided with arcuate slots 54 in alignment with each of the attachment bolts 53 which allows angular orientation of the back plate 22 about the axis of the shaft 24 and the shift lever arm 33 of the shift lever plate 28.

The clamping bolts 53 and particularly slotted heads 55 are accessible through aligned front wall openings 56 in the bezel 21 and mounting wall 20. The back wall 22 is formed with an arcuate recess 57 defining a confining wall means for nut 53*a*, shown as a Hex nut unit. The bolt 53 may therefore be readily tightened and released from the front of the unit. The release holding means and particularly the illustrated embodiment of detent pins 46 and 46' may therefore be oppositely positioned from the illustrated horizontal orientation. The neutral setting position of the shift lever arm 33 may be correspondingly angularly oriented from the true vertical to accommodate the necessary precise location of the diverting gate 11 over the forward jet nozzle 8, as shown in FIGS. 3 and 4.

During the assembly, the detent means 42 and 43 may be released to allow convenient and ready movement of the shift lever 33 and interconnected plate 28. The lever 17 is located in the vertical position and arm 33 is coupled to the connecting cable 35 with gate 11 generally in a neutral throttle position to provide an initial rough neutral adjustment. A fine adjustment is then established by movement of the shift lever 17 to provide the precise positioning of the gate 11 to establish a neutral or stop position. The particular neutral position of arm 33 may vary slightly from a precise vertical position of FIG. 3 to an angle position as shown in FIG. 4 and the detent recesses 44 and 44' will be correspondingly rotated from the horizontal position illustrated in FIG. 4. The recesses 44 and 44' are then moved from alignment with pins 46 and 46'. The back wall or plate 22 which carries the detent pins 46 and 46' is angularly reoriented to align such pins with the offset recesses 44 and 44', after which the plate 22 is locked in position by tightening of bolts 53, as shown in FIG. 4. The detent means 42 and 43 form a holding means which continuously loads the plate to hold it in any position with an increased loading at the neutral position.

The desired neutral position or setting of the control has then been created and the operator can readily locate the neutral position as a result of the force created by moving the lever to engage the detent means.

The illustrated detent means with the movable back wall provides a simple and reliable construction. However, within the broadest aspect of this invention any other releasable means having separable elements coupled to the shift control member and to a relatively fixed member may be employed, with either one or both of the separable elements having an adjustable fixed attachment to the related member. For example, the plate may be constructed with a rotatably lockable outer rim portion carrying a holding means releasably engaging a fixed holding member riding on the peripherial edge. Further, although shown as a mechanical interlock any other suitable releasable holding means which can create a unique and detectable selected position of the shift means may be employed within the broadest aspects of this invention.

This structure has been found to provide a relatively simple and inexpensive means for making the necessary fine adjustment to compensate for manufacture tolerances, differences in engine idle speeds and the like. The present invention is particularly adapted to compensate for manufacturing tolerances such as necessary in the commercial production of jet drive systems with remotely controlled jet diverting means.

Various modes of carrying out the invention are contemplated as being within the scope of the following claims, particularly pointing out and distinctly claiming the subject matter which is regarded as the invention.

I claim:

1. A remote shift control assembly for a marine jet drive system having a diverting control element including movable input means for adjustably positioning thereof, comprising a support means, a moveable shift means moveably mounted to said support means and having means adapted to be coupled to said moveable input means for moving the input means from an initial position, a releasable holding means having interacting elements secured to said moveable shift means and said support means and establishing a releasable holding of said moveable shift means in the initial position, at least one of said interacting elements being moveable in a path parallel to the element secured to the moveable shift means to permit setting of the interacting elements in any one of a plurality of initial positions of said shift means, and releasable locking means to hold the moveable interacting element in said adjusted position.

2. In the control assembly of claim 1 wherein said holding means is a detent means having a recess means and pin means defining the interacting elements.

3. In the control assembly of claim 1 wherein said moveable shift means includes a rotatable shift lever plate having a detent recess means defining one of the interacting elements, and a detent pin means adjustably secured to the support means.

4. The remote control apparatus of claim 1 wherein said support means includes a front support wall having a pair of spaced sidewalls and having a back wall, a shift plate including a shaft journaled in said front and back walls and including a shift lever projecting radially therefrom between said sidewalls, said releasable holding means including a detent means to the opposite sides of said lever, each detent means including a radial recess means in the outer periphry of the plate and a detent pin means mounted in said back wall and resiliently urged into engagement with said face of the plate for selective releasable holding engagement with said recess means, and said locking means releasably securing said back wall to said side walls and including means permitting angular orientation of the back wall about the axis of said shaft.

5. A remote shift control assembly for a marine jet drive system having a jet diverting means for diverting the output of a jet pump means between a forward jet forming drive means and a reverse jet forming drive means and having a coupling means connected to said jet diverting means and a linkage for adjustably positioning thereof, comprising a support means, a moveable shift element moveably mounted to said support means and coupled to said linkage to shift said coupling means, said moveable shift element being oppositely moveable from a neutral position to affect a forward drive and a reverse drive setting of the jet diverting means, a releasable holding means secured to said moveable shift element and said support means and establishing a releasable holding of said moveable shift element in the neutral position, said moveable holding means being movable with said shift element for corresponding setting in any one of a plurality of possible neutral positions, and releasable locking means to lock the releasable holding means in any one of said neutral settings.

6. The remote shift control assembly of claim 5 wherein said releasable holding means includes a continuous loading on said shift element with an increased loading at said neutral position.

7. The remote shift control assembly of claim 5 wherein said shift element includes a rotatably mounted shift lever, said holding means includes a resiliently loaded detent means including a recess and an intergageable detent pin means, separate attachment means connecting one each of the recess means and pins means to said rotatable lever and the support means, and at least one of said attachment means being adjustable along the circular path of the detent means connected to said shift lever.

8. The remote shift control assembly of claim 5 wherein said releasable holding means includes a plurality of circumferentially spaced, resiliently loaded pressure means for loading of shift element to define said neutral position.

9. In the control apparatus of claim 5 wherein said moveable shift element includes a rotatable shift lever plate, a shaft co-axially secured to said plate and journaled in said support means, a lever secured to said plate and having an outer end coupling for coupling to said linkage means, the outer periphery of one face of said plate including a radially extended groove forming a part of said holding means, said holding means including a detent pin resiliently mating with said groove, and pin mounting means adjustably secured to said support means for angular orientation about the axis of said plate.

10. The remote control apparatus of claim 5 wherein said shift means includes a lever, said support means includes a pair of spaced support walls connected by a sidewall and including attachment means releasably securing one of said support walls to said sidewall, a shift lever shaft means journaled in said support walls and including said shift lever projecting radially therefrom between said sidewalls, said attachment means permitting angular orientation of the corresponding support wall about said shaft means axis, said releasable holding means including a pair of interacting elements connected one each to said shift lever and to said adjustably mounted support wall.

11. The remote control apparatus of claim 10 wherein said coupling means includes an elongated push-pull linkage having one end connected to the outer end of the lever and the second end connected to the diverting means.

12. The remote control apparatus of claim 10 wherein said interacting elements define a detent means including a radial recess means in a face of the lever opposed to said one support wall and a detent pin means mounted in said support wall and resiliently urged into engagement with said face for selective releasable holding engagement with said recess means.

13. The remote control apparatus of claim 12 wherein said pin means terminate in an essentially semicircular bearing end and said recess is generally formed with a radius corresponding to that of the end of the pin means.

14. The remote shift control apparatus of claim 5 wherein said support means includes a front support wall having a pair of spaced sidewalls and having a back wall bolt means releasably securing said back wall to said side walls, a shift plate including a shaft journaled in said front and back walls and including a shift lever projecting radially therefrom between said sidewalls, said back wall including arcuate means permitting angular orientation of the back wall about said shaft axis, said releasable holding means including a detent means to the opposite sides of said lever, each of said detent means including a radial recess means in the radially outer face of the plate and a detent pin means mounted in said back wall, and each detent means including an adjustable spring engaging said pin means and resiliently forcing of said pin means into engagement with said face of the plate for selective releasable holding engagement with said recess means, and said front support wall having bearing means to rotatably support said plate with said pin means engaging said plate.

15. In a remote shift control assembly for a marine jet drive system having a diverting gate for diverting the output of a jet pump means between a forward jet forming drive means and a reverse jet forming drive means, comprising a mechanical coupling means having a push-pull element connected to said jet diverting maeans for adjustably positioning thereof, support means, a shift lever rotatably mounted to said support means and coupled to the opposite end of said push-pull element, of said coupling means, to shift said moveable shift lever being oppositely moveable from a neutral position to affect a forward drive and a reverse drive setting of the gate, said lever including a circular coaxial plate, a detent means including a recess formed in said plate and a pin means attached to said support means and establishing a releasable holding of said moveable element in the neutral position, said pin means being moveable in a path parallel to the recess means of the lever plate to permit setting of the detent means in any one of a plurality of possible neutral positions of said lever, and releasable locking means to hold the pin means in said adjusted position.

16. The remote control apparatus of claim 15 wherein said support means includes a front support wall having a pair of spaced sidewalls and having a back wall, bolt means releasably secure said back wall to said side walls, said back wall including arcuate slots permitting angular orientation of the back wall about said lever axis, said arcuate slots being formed within a generally correspondingly shaped recess, and said mounting wall includes opening aligned with said bolt means for in-place adjusting of said back wall.

17. The apparatus of claim 16 wherein said lever includes a shaft journaled in said front support and back walls and locating said shift lever projecting radially therefrom between said sidewalls, said detent means being located to one side of said shaft and a second corresponding detent means located to the opposite side of said shaft.

18. The remote control apparatus of claim 17 wherein each detent means includes a radial recess means in the outer radial portion of the plate, a detent support cylinder integral formed in said back wall with the pin means located therein, a spring within said cylinder resiliently forcing the pin means outwardly into engagement with the plate for selective releasable holding engagement with said recess means.

* * * * *